US006314783B1

(12) United States Patent
Patrick

(10) Patent No.: US 6,314,783 B1
(45) Date of Patent: Nov. 13, 2001

(54) ELECTROMECHANICAL HEMMING APPARATUS AND METHOD

(76) Inventor: William Patrick, 81 Willow Beach Road, RR #2, Amherstburg, Ontario (CA), N9V 2X8

( * ) Notice: Subject to any disclaimer, the term of this patent is extended or adjusted under 35 U.S.C. 154(b) by 0 days.

(21) Appl. No.: 09/565,067

(22) Filed: May 5, 2000

(51) Int. Cl.[7] ..... B21D 39/02
(52) U.S. Cl. ..... 72/306; 72/323; 29/243.58
(58) Field of Search ..... 72/323, 306, 386, 72/384, 452.2, 452.9, 315; 29/243.58

(56) References Cited

U.S. PATENT DOCUMENTS

| | | | | |
|---|---|---|---|---|
| 3,092,057 | * | 6/1963 | Warshilek | 29/243.58 |
| 4,346,579 | | 8/1982 | Takatsu | 72/319 |
| 4,706,489 | | 11/1987 | Dacey, Jr. | 72/315 |
| 4,827,595 | | 5/1989 | Dacey, Jr. | 72/325 |
| 4,901,555 | | 2/1990 | Shimoichi | 72/322 |
| 4,928,388 | | 5/1990 | Dacey, Jr. | 29/243.57 |
| 5,005,398 | | 4/1991 | Evans | 29/243.58 |
| 5,083,355 | | 1/1992 | Dacey, Jr. | 29/243.58 |
| 5,150,508 | | 9/1992 | St. Denis | 29/243.5 |
| 5,272,903 | | 12/1993 | Evans | 29/243.58 |
| 5,315,855 | | 5/1994 | Jackson | 72/315 |
| 5,454,261 | * | 10/1995 | Campian | 72/323 |
| 5,457,981 | | 10/1995 | Brown et al. | 72/243.58 |
| 5,495,742 | | 3/1996 | Dorsett | 29/243.58 |
| 5,507,165 | | 4/1996 | Hartley | 72/311 |
| 5,611,133 | | 3/1997 | Toeniskoetter | 29/243.58 |
| 5,740,691 | | 4/1998 | Kovarovic et al. | 72/306 |
| 5,746,083 | | 5/1998 | Kovarovic et al. | 72/312 |
| 5,752,304 | | 5/1998 | Toeniskoetter | 29/243.58 |
| 5,979,208 | | 11/1999 | Hartley | 72/306 |
| 6,079,250 | * | 6/2000 | Scannell | 72/381 |

FOREIGN PATENT DOCUMENTS

| | | | | |
|---|---|---|---|---|
| 1322218 | * | 2/1963 | (FR) | 72/323 |
| 1445675 | * | 6/1966 | (FR) | 72/323 |
| 929840 | * | 6/1963 | (GB) | 72/306 |

* cited by examiner

*Primary Examiner*—Daniel C. Crane
(74) *Attorney, Agent, or Firm*—Clark & Brody

(57) ABSTRACT

A hemming apparatus comprises a main die configured to supports panels to be hemmed together. The main die is raised and lowered between a home position and a hemming position by a drive using a fixed cam and a moveable cam. The apparatus also includes a hemming die assembly having a pre-hemming and final hemming die block mounted on a frame. An electromechanical motor assembly drives the frame along an inclined path. Shot pins are provided to lock the frame into positions for pre-hemming and final hemming. The frame travels along ways and surfaces associated with frame travel are hand scraped to provide a precision movement of the frame for accurate and consistent hemming operations.

20 Claims, 6 Drawing Sheets

ELECTROMECHANICAL HEMMING APPARATUS AND METHOD

FIELD OF THE INVENTION

The present invention is directed to an electromechanical hemming apparatus and method, and in particular to a method and apparatus offering repeatability in the hemming process, ease of maintenance and operability, simplicity in design, and improved structural integrity.

BACKGROUND ART

In the prior art, it is well known to join together a pair of preformed parts into a single unitary structure. This joining is particularly prevalent in the automotive industry where a hollow door, hood, deck gate, end gate, trunk lid or the like is formed using these joining techniques. Typically, these doors comprise an outer and an inner panel. The edges of the panels are clinched together using a hemming machine or apparatus.

A widely-used process for hemming of door panels involves a pre-hemming step followed by a final hemming step. In the pre-hemming step, a right-angled flange of one panel is bent over a flat edge of another panel by a pre-hemming die surface. In the final hemming step, the bent flange is flattened onto the flat edge of the other panel to form the hem by another final hemming die surface.

Various types of machines have been proposed to perform these types of hemming operations. One type uses a vertically-driven main die and a horizontally-driven hem gate. The hem gate supports the pre-hemming and final hemming die surfaces and is moved laterally or horizontally for hemming. The main die is raised vertically for the hemming steps. These horizontally-driven gates lack accuracy and repeatability in the hemming process. In these machines, there are typically four separate assemblies to hem each side of a rectangular or square unit. Since each assembly may have its own main die, and drive for the hemmers, the overall apparatus is rather clumsy and bulky.

Another type of hemming machine uses a linkage and a swing-type motion to allow the pre-hemming and final hemming surfaces to contact the flange for hemming. The complicated drive mechanisms associated with these machines make them expensive and can cause unwanted variations over time in hemming performance.

Another hemming apparatus is disclosed in U.S. Pat. No. 5,150,508 to St. Denis. This patent discloses a hemming machine using the horizontally-driven hem gate and vertically-driven main die described above. In St. Denis, the main die is raised hydraulically between two positions for pre-hemming and final hemming. A lifter is used to then remove the hemmed part or load a unit to be hemmed. This machine also suffers from the drawbacks noted above.

In light of the disadvantages of the prior art hemming machines, a need has developed to provide improved hemming apparatus and methods. The present invention solves this need by providing a hemming apparatus having an improved main die drive, an improved hemming die surface drive, and a unique and novel manner in which to position the die surfaces in conjunction with movement of the main die for hemming purposes.

SUMMARY OF THE INVENTION

It is a first object of the present invention to provide an improved hemming apparatus.

Another object of the present invention is to provide an improved method of hemming parts together.

Yet another object of the invention is a hemming apparatus that uses an improved drive assembly for bringing the parts to be hemmed in contact with the hemming die blocks.

A further object of the invention is a hemming apparatus that employs an improved drive assembly for the hemming die blocks.

Other objects and advantages of the present invention will become apparent as a description thereof proceeds.

In satisfaction of the foregoing objects and advantages, the present invention provides a hemming apparatus for joining a flat edge of a first panel to an angled edge of a second panel comprising a main die configured to support the first and second panels. The apparatus has a main die drive connected to the main die for moving the main die vertically between at least a home position and a hemming position. At least one hemming die block assembly is provided with a pre-hemming die block and a final hemming die block supported by a frame.

The apparatus further comprises at least one hemming die block assembly drive mounted on a fixed support and positioned adjacent the main die. The drive is adapted to move the frame along a drive path inclined with respect to vertical for positioning each of the pre-hemming die block and the final die block at the hemming position to perform pre-hemming and final hemming on the flat edge of the first panel and the angled edge of the second panel. Although the inclination can vary to achieve a desired main die stroke and the proper hemming die block coverage, a preferred inclination is 10–20 degrees from vertical, more preferably, between about 15 and 20 degrees.

The main die drive can comprises a pair of first and second cams, the first cam fixed to the die and having a first cam surface, the second cam having a second cam surface and being mounted to a drive mechanism for translation between a first position and a second position. The first position corresponds to a home position of the main die and the second position corresponds to a hemming position of the main die whereby translation of the second cam against the first cam raises the main die for pre-hemming and final hemming. The drive can translate the second cam in one of a rotary movement, an arcuate movement or a linear movement to move the main die. The cam surfaces can be complementary helical surfaces, or angled surfaces depending on the direction of movement.

The frame can be mounted on a pair of inclined ways for travel along the inclined drive path. The frame can have a keeper mounted adjacent to each way to retain the frame on the pair of ways. At least one surface of surfaces of the keepers, ways, and frame that oppose each other and move with respect to each other can have a hand scraped surface to maintain precision travel of the frame during the positioning of the pre-hemming and final hemming die blocks.

The at least one hemming die block assembly can further comprise at least one shot pin mounted to the fixed support, the shot pin having a pin moveable between a rest position and a fixing position. The frame can have at least one first opening for pre-hemming and at least one second opening for final hemming. Each of the at least one first and second openings are sized to receive an end of the pin, the shot pin operable to extend the at least one pin into the first opening to fix the frame and the pre-hemming die block for pre-hemming after frame movement of the pre-hemming die block to the hemming position, and to extend the at least one pin into the second opening to fix the frame and the final hemming die block for final hemming after frame movement of the final hemming die block to the hemming position.

The frame can have a gear rack mounted thereon, and the at least one hemming die block assembly drive can further comprise a gear driven by a motor assembly, rotation of the gear by the motor assembly and meshing of the gear with the gear rack moving the frame along the inclined drive path.

The inventive method entails hemming a flat edge of the first panel to an angled edge of the second panel to form a joint by elevating a pre-hemming die block along the inclined path for pre-hemming. Then, a main die supporting the first and second panels is raised so that the angled edge of the second panel is at the hemming position. The angled edge is forced against the pre-hemming die block to bend the angled edge toward the flat edge. The main die is lowered and the final hemming die block is elevated for hemming. The main die is then raised so that the bent edge of the second panel is at the hemming position, and the bent edge is flattened against the final hemming die block to form the joint.

The unique main die drive can also be employed with a conventional hemming apparatus. As well, the drive for the frame and the frame itself can be used with a conventional main die assembly and drive.

BRIEF DESCRIPTION OF THE DRAWINGS

Reference is now made to the drawings of the invention wherein.

DESCRIPTION OF THE PREFERRED EMBODIMENTS

The present invention offers significant advantages in the field of hemming parts together, particularly automotive parts. The apparatus of the invention uses far less motions than prior art devices. For example, where a prior art machine may require 10 motions, the inventive apparatus can hem using only 6 main motions. In addition, due to the various features of the invention, hemming operations can be performed with great precision and repeatability. The unique travel and inclination of the pre-hemming and final hemming die blocks of the invention offer benefits in terms of clearances on the machine, the need for only one relatively short stroke of the main die, flexibility in the sequencing of the pre-hemming and final hemming steps, flexibility in terms of the number of units needed to perform a particular hemming, the ability to use the same units for corner hemming, and the ability to use high-grade tool steel in place of the mid-grade steel of the prior art designs.

Figure 1:
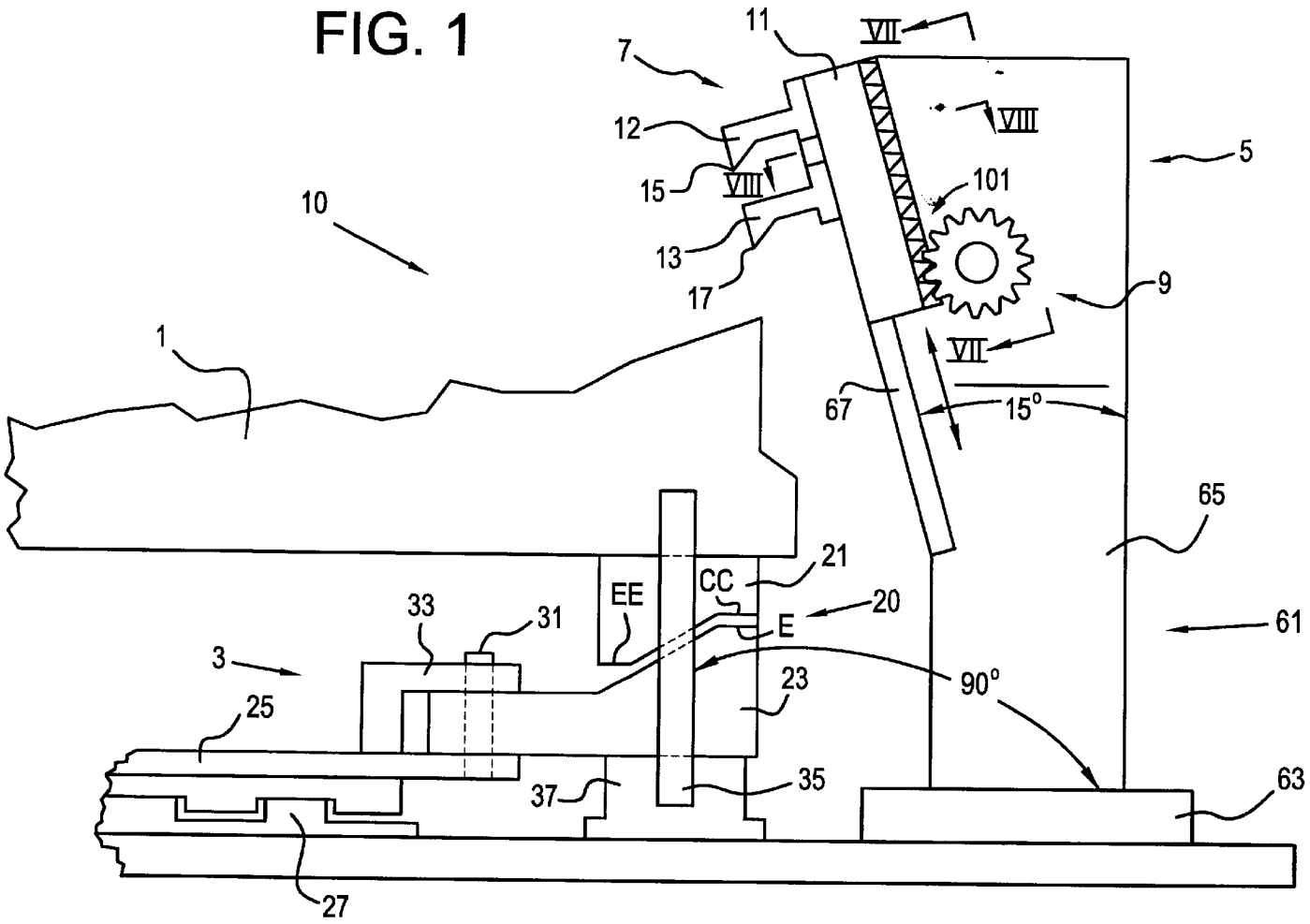
FIG. 1 is a schematic view of one embodiment of the inventive apparatus.

Referring now to the embodiment depicted in FIG. 1 and designated by the reference numeral 10, the apparatus includes a main die 1, a main die drive 3, and a hemming die assembly 5 comprising a die block assembly 7 and a drive 9.

The main die drive 3 is designed to move the main die from a home or at-rest position as depicted in FIG. 1 to an elevated or hemming position. Although not shown, the main die also includes a lifting device for loading and unloading parts to and from the main die for hemming. Since these lifters are well known in the hemming art, a further description thereof is not deemed necessary for understanding of the invention.

The hemming die assembly 5 operates in concert with movement of the main die to perform pre-hemming and final hemming steps. To accomplish these steps, the die block assembly 7 has a platen 11 that supports a pre-hem die block 12 and final hem die block 13. Each of the die blocks 12 and 13 has a specifically angled hemming surface 15 and 17 to perform the hemming operations.

The platen 11 is mounted for travel along a pair of ways 67 and 69 (only one shown in FIG. 1) at an inclination with respect to vertical. The drive 9 moves the platen 11 along the ways 67 and 69 as part of the hemming operation.

Figure 2A:
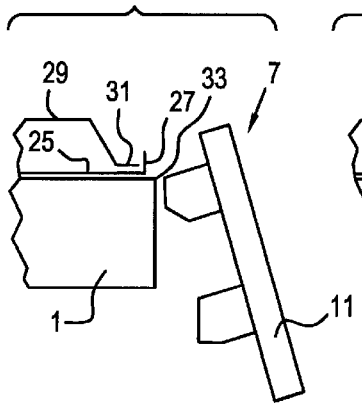
FIGS. 2*a*–2*g* show an exemplary hemming sequence using the apparatus of FIG. 1.

The basic operation of the apparatus 10 is shown in sequential fashion in FIGS. 2*a*–2*g*. In FIG. 2*a*, the main die 1 is at the home position and is loaded with a first panel 25 having a right angle flange 27 and a second panel 29 with a flat edge 31. The panels 25 and 27 are positioned on the main die with a gap or space from the edge 33. Having the panels removed from the edge 33 avoids reading or forming a line or crease from the edge 33 into a surface of the panel 25 during hemming. Preferably, this gap is about 0.125 inches. The die block assembly 7 is also at the home position in FIG. 2*a*.

Figure 2B:
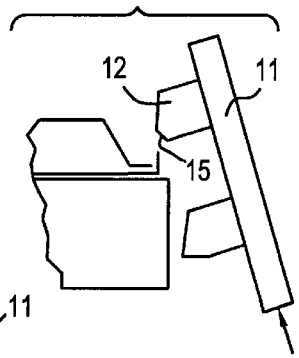

Referring to FIG. 2*b*, the die block assembly 7 is raised by the drive 9 such that the pre-hem die block 12 is ready for pre-hemming. The die block 12 is positively secured at this position by a shot pin assembly to be described below.

Figure 2C:
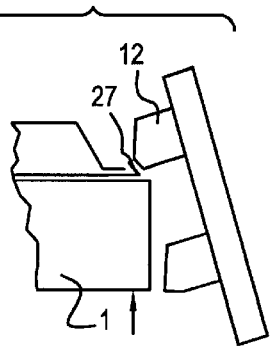

The main die drive 3 then elevates the main die 1 to a hemming position so that the flange 27 is bent to approximately 45 degrees by action of the flange contacting the surface 15 of the pre-hem die block 12, see FIG. 2c. The surface 15 is appropriately angled taking into account the inclination of the hemming die assembly 5 so that the flange 27 is bent at the desired angle. The drive 3 is sized with sufficient power to press the main die 1 against the die surface to bend the upturned flange 27.

Figure 2D:
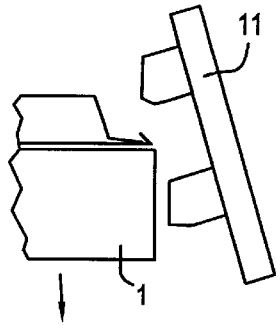
Figure 2E:
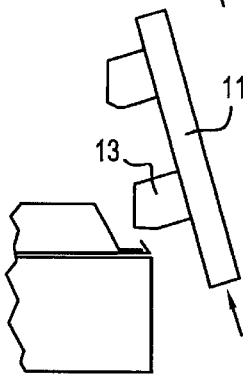

In FIG. 2*d*, the main die drive 3 lowers the main die 1, and the drive 9 moves the platen 11 upwardly, see FIG. 2*e*, so that the final hem die block 13 is ready for final hemming.

Figure 2F:
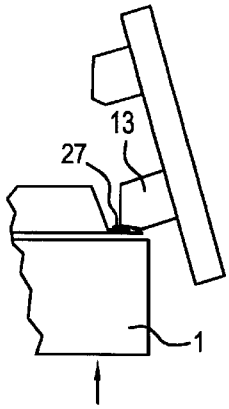

Referring to FIG. 2f, the main die 1 is elevated again by the drive 3 to the hemming position so that the flange 27 is completely folded over the edge 31 and the panels 25 and 29 are joined where edges 27 and 31 interface. Since the main drive is elevated only to one position, this position is referred to as the hemming position. The pre-hemming and final hemming die blocks are also moved to the same hemming position, and it is the platen 11 which moves to a pre-hemming position, FIG. 2*b*, and a final hemming position, FIG. 2*e*.

The main die 1 is lowered, as is the platen 11, for removal or repositioning of the panels 25 and 29 for further hemming.

It should be understood that while only one hemming die block assembly 7 is shown in FIGS. 2*a*–2*g*, a number of the assemblies 5 could be positioned around the main die 1 to hem the edges of the panels 25 and 29, either simultaneously or in sequence. Since each hemming die assembly 5 has its own drive, the pre-hemming and/or final hemming can be done independently or together. In addition, separate hemming die assemblies 5 could be employed for corner hemming with the appropriately-shaped die blocks. The mechanism for raising and lowering the platen will be the same for corner hemming, just that the nosepiece for hemming will be different.

The ability to have a separate base for the corner clinching or clamping units is a significant advantage over certain hemming machines such as disclosed in the St. Denis patent noted above. In some of these machines, the corner clinch mechanism base is cast as an integral part of the main die so that it travels up and down with the main die. Because of this, the main die is difficult to cast and is generally cast from a mid-grade tool steel. With the inventive apparatus, corner-clinching units are stand alone and self-driven units. Thus, the main die does not have to support these units, and the main die can be cast from a high-grade tool steel, thereby offering superior quality and longer life.

Figure 2G:
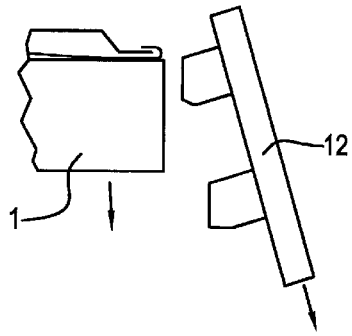
Figure 4:
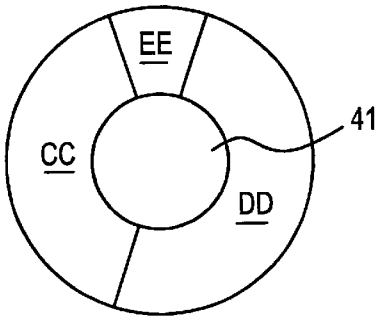
FIG. 4 is a bottom view of the fixed lift cam of the main die drive assembly of FIG. 1.
Figure 3:
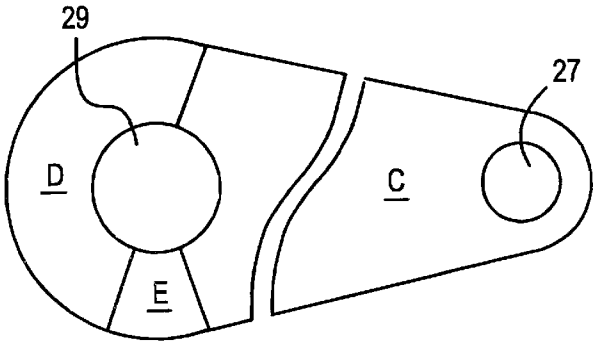
FIG. 3 is a top view of the helical cam of the main die drive assembly of FIG. 1.

The apparatus depicted in FIGS. 1–2*g* offers significant advantages over prior art hemming apparatus and methods. First, the main die is moved only to a single position, where both pre-hemming and final hemming occur by reason of the movement of the hemming die assembly 5. This single position movement of the main die allows for a shorter stroke for hemming than is used in machines requiring the main die to move to two different positions, e.g., the St. Denis apparatus of U.S. Pat. No. 5,150,508. Thus, a low profile apparatus can be installed, which can then reduce overhead requirements and costs.

The main die, the fixed lift cam, and the helical cam are preferably made of a high-grade tool steel to allow for heat treatability, strength, and wear resistance.

Another aspect of the invention is the electromechanical main die drive 3, which offers advantages over the commonly-used hydraulic drives of the prior art. The main die drive has a number of cam sets that interact with each other and a cam actuator for extremely precise and consistent raising and lowering of the main die. This precision and repeatability is crucial to longevity and performance when performing a vast number of hemming operations over time.

Referring again to FIG. 1 and FIGS. 3–5*a*, each cam set is designated by the reference numeral 20 and comprises a fixed cam 21 and a helical cam 23. Each fixed cam 21 is secured to the underside of the main die 1. Each helical cam 23 is supported by a cam plate 25, the plate 25 designed to be driven along guides 27 by a drive (not shown in FIG. 1).

The helical cam 23 is elongate in shape and has a pair of openings 27 and 29. Opening 27 allows the cam to be rotatably mounted to the cam actuator plate 25. A pin 31 extends between member 33 and the plate 25 to allow the helical cam to rotate about the axis of pin 31. The pin can be secured in any conventional fashion.

Opening 29 is sized to receive the main die vertical guide 35, which fixes the helical cam 23 for rotation about an axis of the guide 35. The guide 35 also fixes the position of the fixed cam 21 as well as the main die 1 by extending from the fixed base 37, through the opening 29 in helical cam 23 and another opening 41 in the fixed cam 21. Through rotation of the helical cam 23 against the fixed cam 21, the main die raises and lowers along the guide 35.

Still referring to FIGS. 1 and 3–5*a*, the helical cam 23 has a helical upper surface comprising surfaces "C", "D", and "E". Surface C ramps upward along a helix curve to surface E. Similarly, the fixed cam 21 has a helical surface comprising surfaces "CC", "DD", and "EE", surface CC ramping up to surface EE via surface DD.

In FIG. 1, the surface E of helical cam 23 is shown aligned with surface CC of fixed cam 21. Upon rotation of the helical cam about guide 35, the surface E ramps up along surfaces CC and DD until it engages surface EE of the fixed cam 21. This rotation of the helical cam 23 lifts the main die 1 into the hemming position for both pre-hemming and final hemming. Once the hemming is performed, the helical cam 23 is rotated back to the position shown in FIG. 1 to bring the main die 1 to the home position. During this lowering of the main die 1, the surface E of the helical cam 23 ramps downward along surfaces EE and DD to again interface with surface CC of the fixed cam 21.

Figure 6:
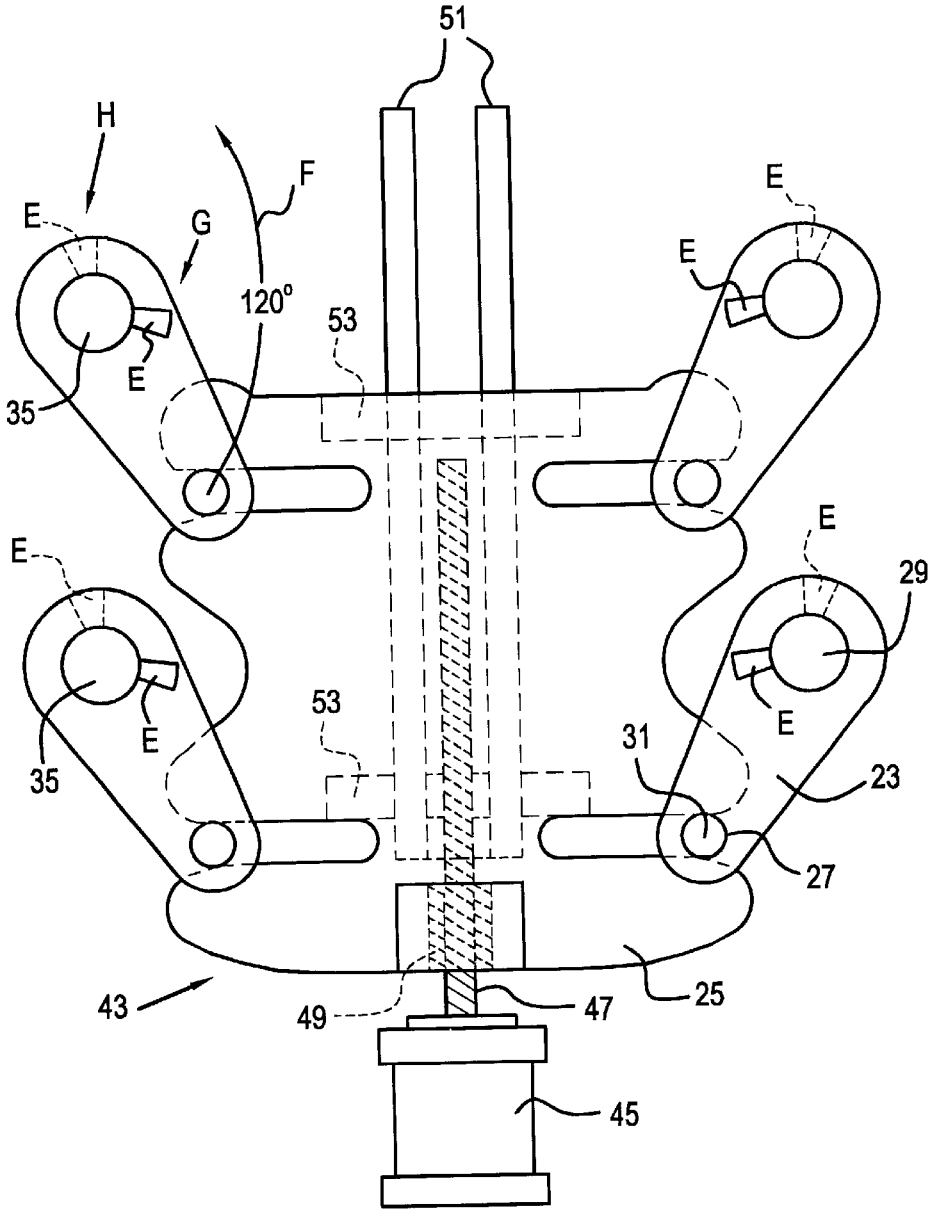
FIG. 6 is a top view of the cam actuator of the main die drive of FIG. 1.

FIG. 6 illustrates an exemplary cam actuator assembly 43 for imparting a rotation to the helical cam 23 for raising and lowering of the main die 1. The assembly 43 employs four helical cams 23 for raising and lowering the main die 1, two right hand cams and two left hand cams. Each helical cam 23 is rotatably mounted to the plate 25 as shown in FIG. 1. The assembly 43 includes the plate 25 that is linked to an electric motor 45 via a ball screw 47 and a ball nut 49. When the motor 45 is energized, the ball screw 47 turns in the ball nut 49, and drives the plate 25 along the guides 51 and the guide supports 53. Movement of the plate 25 causes the pins 31 to move in an arc "F". This arcuate motion then rotates the helical cams 23 so that surface E travels from position "G" to position "H". As described above, the rotation of surface E raises the main die 1 to the desired hemming position.

The motor 45 is controlled to stop at the hemming position for the hemming of the edges of the panels together. The motor 45 then is reversed to reverse the rotation of the helical cams 23 and lower the main die 1. The raising and lowering of the helical cams 23 is performed twice, once for pre-hemming and a second time for final hemming.

In the FIG. 6 embodiment, four guides 35 are used to accurately fix the main die 1. The guides 35, the base 37, as well as any related bushings or supports are preferably made of precision ground hard steel to ensure precise travel and location of the main die 1.

Figure 5C:
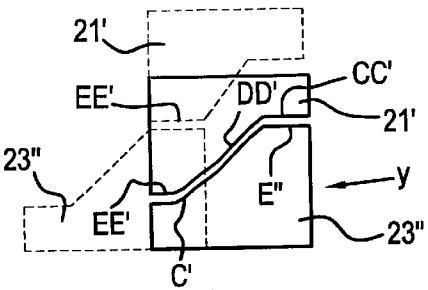
FIG. 5*c* is a schematic of yet another cam arrangement of the invention.
Figure 5B:
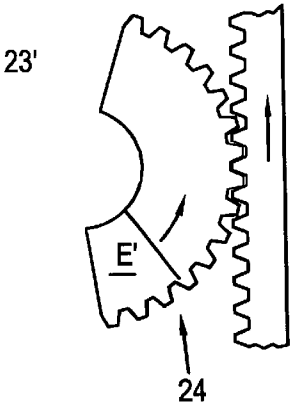
FIG. 5*b* is a schematic of another cam arrangement of the invention.
Figure 5A:
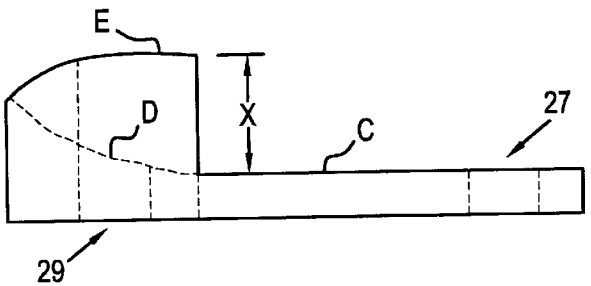
FIG. 5*a* is a side view of the helical cam of FIG. 3.

Referring back to FIG. 5*a*, the helix angle can be varied to change the speed at which the ramping up and down occurs. A lower angle will cause the main die to travel more slowly with a steeper angle causing a higher rate of travel. The height of the helix angle can also be altered to affect the stroke of the main die. The stroke in FIG. 5*a* is represented by the distance "x", the distance between surfaces C and E. If x is increased, the stroke of the main die will be increased. Likewise, reducing x will decrease the main die stroke.

Although four helical cams are illustrated in FIG. 6, any number of cams could be used, as could differently configured plates. For example, the plate could be designed with not only externally arranged helical cams but could include mountings for helical cams positioned internally of those along the plate periphery.

Other types of guides could be employed to control the movement of the plate in place of the guides 51 and supports 53 as would be within the skill of the art. In addition, the actuator plate could be used to drive a pair of helical cams, and a slave bar or drag link could be employed to drive the other pair of helical cams, if so desired.

While a motor, a ball screw, and a ball nut are exemplified to drive the plate, alternative drives may be employed for cam rotation. For example, in FIG. 5*b*, the helical cam could be made in a cylindrical form 23' with a gear cut 24 into its outer surface. A gear rack 28 could then be positioned adjacent to the cam 23'. Movement of the gear rack 28 as it engages the gear 24 on the cam would cause the cam 23' to rotate and move surface E' for main die movement.

In another alternative, the cams 23 could use a slide action rather than a rotational action for raising and lowering of the main die 1. Referring to FIG. 5*c*, the cam 23" has surface E" facing surface CC' of the fixed cam 21'. The cam 23" is driven in the direction of arrow Y so that the surface E" ramps along surfaces CC' and DD' to arrive at surface EE'. This ramping causes the fixed cam 21' to rise as shown in phantom for raising of the main die 1. An exemplary angle of the cam 23' may be about 30 degrees. Again, the stroke and rate of movement can be adjusted by altering the angle and distance between surfaces C' and E'.

Figure 7:
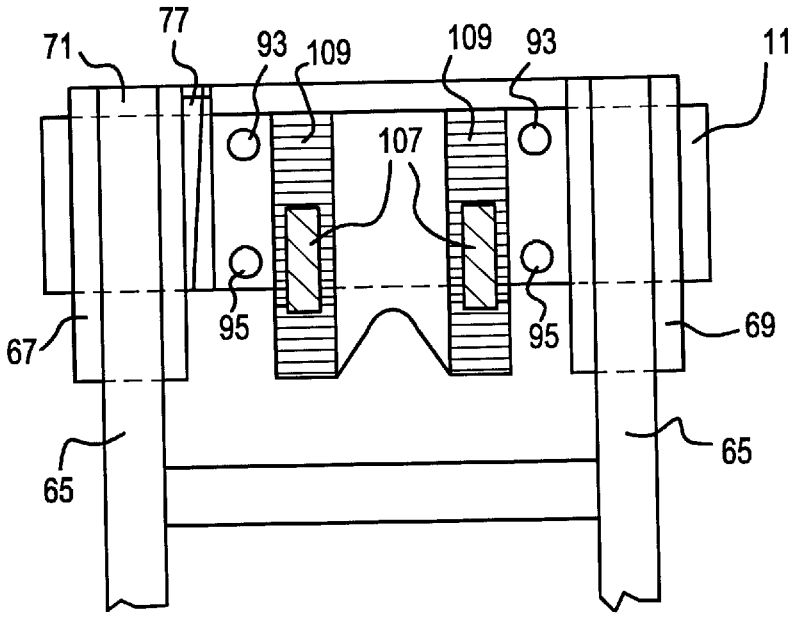
FIG. 7 is a rear view along the lines VII—VII of the platen assembly of FIG. 1.
Figure 8:
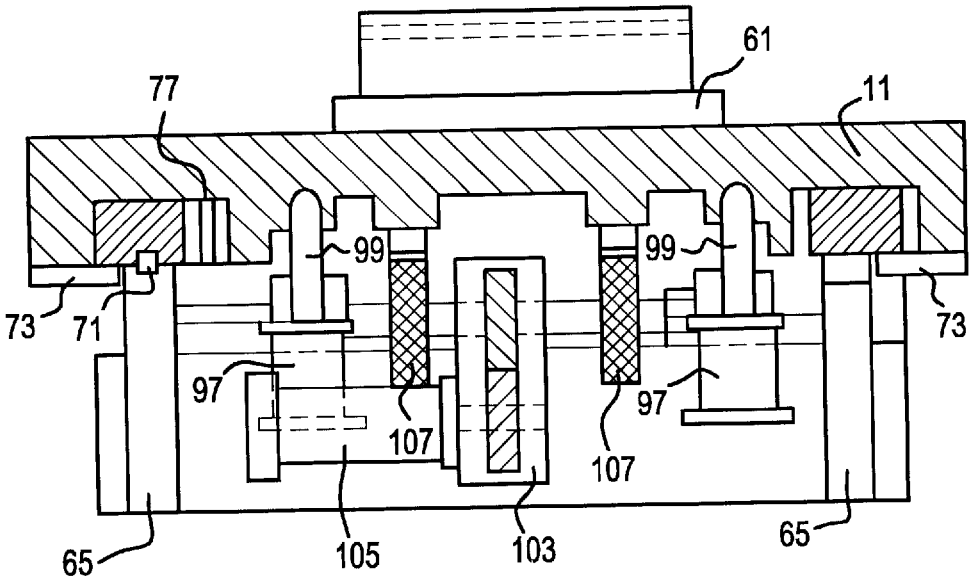
FIG. 8 is a sectional view along the lines VIII—VIII of the platen assembly of FIG. 1.

A further aspect of the invention entails the hemming die assembly 5 and the manner in which the pre-hem and final hem die blocks are mounted and moved for hemming. Referring to FIGS. 1, 7, and 8, the frame or platen 11 of the die block assembly 7 supports the die blocks 12 and 13 via a subplate 61. The die blocks are preferably mounted and keyed to the subplate 61, and the subplate 61 in turn is mounted to the platen 11.

A base 61 is employed to support the assembly 7 and the drive 9. The base 61 is made of a sturdy construction comprising base plate 63 and a pair of upstanding vertical columns 65. The base 61 and its components are preferably made as an all-welded construction. Preferably, the columns 65 are stress relieved and oven normalized prior to any machining operations for fixing the various components of the die assembly 5.

Secured to the columns 65 are a pair of ways 67 and 69. One way 67 is a positive or controlling way that is responsible for the accuracy of the travel of the platen 11. The other way 69 is a slave way that merely helps holds the platen 11 in place.

The positive way 67 is keyed to one of the columns 65 at 71 for exacting location and stability. The platen 11 is held in place by a pair of keepers 73. The keepers 73 are mounted to the platen 11 in conventional fashion. To ensure that the platen 11 moves up and down with absolute accuracy, a tapered jib 77 is provided adjacent to the positive way 67, the jib 77 fitting into a tapered slot formed by the platen 11 and the way 67. It is preferred to make the platen, the keepers and the tapered jib from 40,000 psi cast steel that is oven normalized prior to machining.

To ensure the accuracy of the travel of the platen 11, the surfaces that contact each other during travel of the platen 11 are hand scraped to assure flatness therebetween. Hand scraping is used in the machining industry as a means for opposing surfaces of two components to mesh very closely together with little or no clearance therebetween. The process generally involves covering one face of the two components with a spotting medium, e.g., blueing, an oil based paint-type substance. The medium is applied smoothly and thinly to the intended surface. The surface of the second component to be mated with the first component is applied to the spotting medium-containing first component's surface. One or both components are moved around slowly, and then the two faces are separated. The high points will have the blueing substance thereon and a scraper can be employed to then scrape the high points. The scraper is generally a chisel or the like. The spotting process is repeated until no more high points are found. Then, the two faces are essentially flat and have little or no clearance therebetween. Consequently, when one surface slides along the other hand scraped surface, the travel of the moving surface of the component is not only true but also will be consistent over time, e.g., repeatable.

Figure 9:
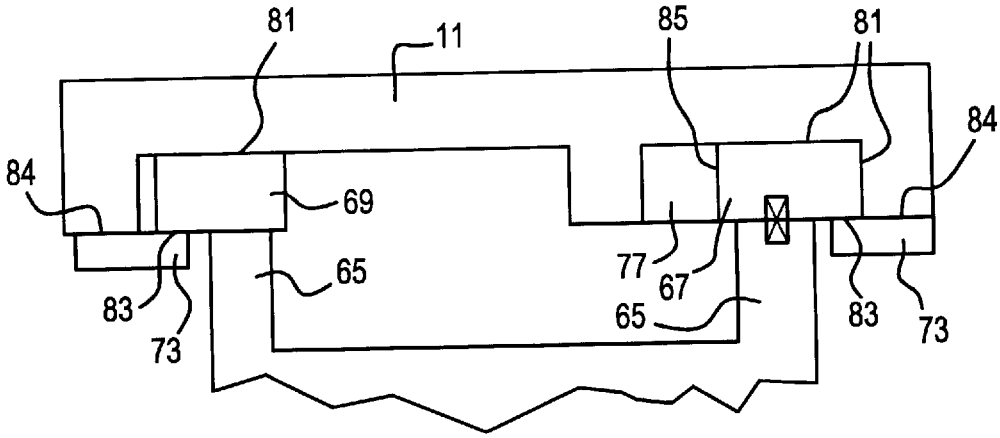
FIG. 9 is a schematic showing the arrangement of the ways, keepers, and taper jib of the platen assembly of FIG. 7.
Figure 10:
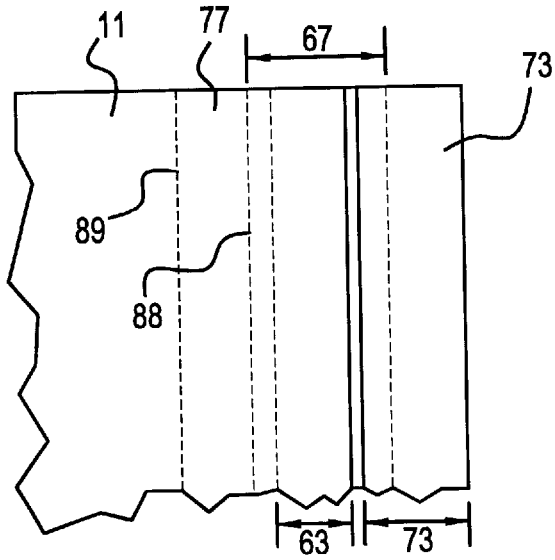
FIG. 10 is another and rear view schematic of the arrangement of FIG. 9.

FIGS. 9 and 10 show the surfaces that are preferably hand scraped. The platen 11 will slide along way 67 at surfaces 81 and way 69 at surface 82. The surfaces 83 of the keepers 73 slide along the ways 67 and 69. In addition, the tapered jib 77 travels along the surface 85 of the way 67. A preferred sequence of scraping begins with scraping the platen 11 into the ways 67 and 69 to assure an accurate fit. The surfaces 83 and 84 of the keepers 73 are scraped to assure that the keepers 73 are flat with respect to both ways 67 and 69 and the platen 11. The tapered jib 77 is then spotted or blued into the two faces 88 and 89 of FIG. 10. When the hand scraping is finished and the platen 11, keepers 73, and ways 67, 69 are assembled together, the platen 11 accurately and precisely travels on the inclined ways as shown in FIGS. 1–2*g*.

The hand fitting of the platen 11 to the ways 67 and 69, the keepers 73 and the taper jib 77 ensures a constant and infinite travel from point to point without any appreciable deviation. Thus, the inventive hemming apparatus can consistently and routinely hem panels with great accuracy for an extended period of time with minimal maintenance, alignment, and/or repair. It is preferred to manufacture the ways 67 and 69 in pairs, and the ways' thicknesses and parallelism should be closely matched to each other, preferably within microns.

Referring back to FIGS. 7 and 8, the platen 11 also has two sets of shot pin openings 93 and 95. The openings 93 align the platen 11 for pre-hemming and the openings 95 align the platen 11 for final hemming. The openings interact with a pair of shot pins 97 that are mounted to the columns 65. The shot pins 97 fix the platen 11 in position for pre-hemming and final hemming. Each shot pin 97 is preferably driven by an independently operated air cylinder, whereby upon pressurization of the cylinder with air, the pins 99 are driven toward the platen, with each pin end entering the selected opening 93 or 95. With the die blocks 12, 13 firmly mounted to the platen 11, and the shot pins 97 accurately mounted to the columns 65 via bushings or the like, actuation of the shot pins 97 will establish the exact location of the die blocks for hemming, time after time. Although two shot pins are depicted, one or more than two could be utilized if so desired. Similarly, the number of openings in the platen 11 could also vary with the number of shot pins employed.

Preferably, the openings 93 and 95 are machined into the platen 11 to ensure precision location of the die blocks for hemming. Similarly, the shot pins 97 are located on the vertical columns 65 using machining techniques for accurate placement of the shot pins 97.

The platen is driven by a gear and rack assembly 101 comprising a gear box 103, a motor 105, a pair of gears 107, and gear racks 109. In operation, the motor 105 is energized to rotate the gears 107 along the racks 109. This advances the platen 11 upward from the home position, see FIG. 2*a*, to the pre-hem position, FIG. 2*b*. The shot pins 97 are then actuated to lock the platen 11 into an exact location. The main die 1 is raised and lowered for pre-hemming as described above, see FIGS. 2*c* and 2*d*.

The pins 99 are removed from openings 93 by controlling the compressed air of the shot pins 97, and the motor and gear box 103 and 105 are energized to move the platen 11 to the final hem position. Once the motor 105 stops, the shot pins are again actuated with the pins 99 entering the openings 95 to precisely locate the platen 11 for final hemming. The final hem cycle takes place, see FIGS. 2*f* and 2*g*. Once the main die 1 is lowered, the cycle can begin again.

The inventive apparatus offers other advantages than those mentioned above when compared to the state of the art. Many of the components for the drives and other assemblies are standard off-the-shelf items, thereby simplifying the overall machine design. Due to the simplicity of the design, the machine is readily accessible for maintenance, and any of the vertical columns 65 can be easily removed and replaced when and if service is required. Retraction of the platen allows for unencumbered access to the main die 1, panels thereon, or other components associated with the overall hemming apparatus.

In conjunction with manufacturing the main die and fixed and moveable cams of high-grade tool steel, all pivot and rotational points are preferably fitted with hardened and ground liners and bushings. All pivot pins, guides, and ways will also be made of hardened and ground tool steels. An exemplary steel for the ways and guides is an S.A.E. 1060.

The inclination of the platen 11 and related components can vary but a preferred range is between about 10 to 20 degrees, more preferably 15–20 degrees. Adjusting the inclination of the platen 11 affects the stroke of the main die and the hemming coverage of the die blocks surfaces 15 and 17. Using a 15-degree inclination allows for a 2.0 to 2.5 inch stroke of the main die and a 0.375 inch hem coverage. The hem coverage width is that portion of the die block that overhangs the main die 1. Increasing the inclination, >15 degrees, reduces the stroke height and increases the hemming coverage, whereas decreasing the angle, <15 degrees, increased the stroke height and decreases the hemming coverage. As is apparent from this description, too much or too little of an inclination interferes with an optimum arrangement of both the right amount of stroke and the proper hemming coverage. The inclination of the drive path of the platen should be sufficient to minimize the main die stroke while providing sufficient coverage of the panel edges by the die block surfaces for hemming.

As the inclination of the platen 11 can vary, the angulation of the die block surfaces 15 and 17 can vary as well. Depending on the angulation of the platen and its drive path, the die block surfaces can be configured to angle the edges of the panels as a particular application deems appropriate. For example, with a 15-degree angulation, a 45-degree pre-hem would dictate that the die block surface 15 be angled at 60 degrees measured from horizontal. The die block surface 17 would be angled at 15 degrees from horizontal to complete the hem as shown in FIG. 2*f*.

The outer panel 25 can be located by peripheral side locators or wipers. These mechanisms will guide the panel into the proper location as a lifter mechanism (not shown but conventional) lowers the panel onto the main die 1. The locators or wipers can be electromechanical actuators that provide a desired linear motion. The locators or wipers are mounted in the appropriate location to allow for positioning of the outer panel for later hemming. One location can be on the platen 11. The locators can either retract or bury themselves in pre-machined clearances in behind the die blocks. Of course, other locations and other types of locators can be used to position the outer panel 25 for hemming.

The inner panel 29 is preferably clamped in place by an air operated spring loaded overhead stand alone bridge, or a spring loaded and air operated slide clamp package. If desired, the bridge or slide package can include locator pins to facilitate positioning the inner panel with respect to the outer panel. Of course, other positioning techniques can be employed to orient the panels 25 and 29 in the proper position for hemming.

The sequence of FIGS. 2*a*–2*g* can be performed quite rapidly, thereby offering further benefits in terms of productivity. A typical cycle is estimated at about 14.5 seconds as follows: (1) place lifter down 0.5 sec.; (2) advance panel hold down 0.5 sec.; (3) lower hold down 0.5 sec.; (4) advance hold down shot pin, clamp hold down, advance platen to pre-hem position and secure pre-hem die blocks with shot pins 1.0 sec.; (5) elevate main die and pre-hem, 1.5 sec.; (6) lower main die and retract shot pin from platen 1.5 sec.; (7) advance platen to final hem position 1.0 sec.; (8) advance shot pin in platen to secure final hem die block position 0.5 sec.; (9) elevate main die and final hem 1.5 sec.; (10) lower main die and retract shot pins 1.5 sec.; (11) lower platen to home position, retract shot pins in hold down, and unclamp hold down 1.5 sec.; and (12) elevate hold down, retract hold down, and raise lifter up 2.5 sec.

As part of the inventive method, the apparatus allows for flexibility in hemming. For example, for an automobile hood, the fender sides could be pre-hemmed, and then the cowl and latch sides could be pre-hemmed. Alternatively, the fender sides could be completely hemmed followed by complete hemming of the cowl and latch sides.

Since the die blocks do not impede the overhead zone of the main die, ready accessibility is provided for part locating pins in the inner panel and near the outside edge of the panel, e.g., 6 inches from the edge.

Unlike the apparatus of the St. Denis patent noted above, the inventive apparatus allows for full peripheral hold down clamping via pre-hemming thus providing a desirable transitional flow around the panel periphery.

It should be understood that the improved main die drive could be used in conjunction with a conventional hemming apparatus as well as in combination with the inventive apparatus. Similarly, the improved drive arrangement for the inclined platen could be employed with a conventional drive for the main die. Although each individual drive or platen arrangement offer advantages over the prior art, using the two drives with the inclined platen provides even further advantages as noted above.

As such, an invention has been disclosed in terms of preferred embodiments thereof which fulfills each and every one of the objects of the present invention as set forth above and provides new and improved hemming apparatus and method.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A hemming apparatus for joining a flat edge of a first panel to an angled edge of a second panel comprising:

a) a main die configured to support the first and second panels;

b) a main die drive connected to the main die for moving the main die vertically between at least a home position and a hemming position;

c) at least one hemming die block assembly comprising a pre-hemming die block and a final hemming die block supported by a frame;

d) at least one hemming die block assembly drive mounted on a fixed support and positioned adjacent to the main die, and adapted to move the frame along a drive path inclined with respect to vertical for positioning each of the pre-hemming die block and the final die block at the hemming position to perform pre-hemming and final hemming on the flat edge of the first panel and the angled edge of the second panel.

2. The apparatus of claim 1 wherein the inclination of the drive path varies between about 10 and 20 degrees.

3. The apparatus of claim 1, wherein the main die drive further comprises first and second cams, the first cam fixed to the die and having a first cam surface, the second cam having a second cam surface and being mounted to a drive mechanism for translation between a first position and a second position, the first position corresponding to the home position of the main die and the second position corresponding to a hemming position of the main die whereby translation of the second cam against the first cam raises the main die for pre-hemming and final hemming.

4. The apparatus of claim 3, wherein the drive translates the second cam in one of a rotary movement, an arcuate movement, or a linear movement to move the main die.

5. The apparatus of claim 3, wherein each of the first and second cam surfaces have a pair of generally flat surfaces connected by a helical ramp for raising and lowering of the main die.

6. The apparatus of claim 1, wherein the frame is mounted on a pair of inclined ways for travel along the inclined drive path, the frame having a keeper mounted adjacent to each way to retain the frame on the pair of ways, at least one surface of surfaces of the keepers, ways, and frame that oppose each other and that move with respect to each other having a hand scraped surface to maintain precision travel of the frame during the positioning of the pre-hemming and final hemming die blocks.

7. The apparatus of claim 1, wherein the at least one hemming die block assembly further comprises at least one shot pin mounted to the fixed support, the shot pin having a pin moveable between a rest position and a fixing position, the frame having at least one first opening for pre-hemming and at least one second opening for final hemming, each of the at least one first and second openings sized to receive an end of the pin, the shot pin operable to extend the at least one pin into the first opening to fix the frame and the pre-hemming die block for pre-hemming after frame movement of the pre-hemming die block to the hemming position, and to extend the at least one pin into the second opening to fix the frame and the final hemming die block for final hemming after frame movement of the final hemming die block to the hemming position.

8. The apparatus of claim 1, wherein the frame has a gear rack mounted thereon, and the at least one hemming die block assembly drive further comprises a gear driven by a motor assembly, rotation of the gear by the motor assembly and meshing of the gear with the gear rack moving the frame along the inclined drive path.

9. The apparatus of claim 6, further comprising a tapered jib inserted between one of the ways and a tapered face of the frame to assist in precision movement of the frame.

10. A method of hemming a flat edge of a first panel to an angled edge of a second panel to form a joint comprising:

a) elevating a pre-hemming die block along an inclined path to a hemming position;

b) raising a main die supporting the first and second panels so that the angled edge of the second panel is at the hemming position and forcing the angled edge against the pre-hemming die block to bend the angled edge toward the flat edge;

c) lowering the main die and elevating a final hemming die block to the hemming position; and d) raising the main die so that the bent edge of the second panel is at the hemming position and flattening the bent edge against the final hemming die block to form the joint.

11. The method of claim 10, wherein each of the flat edge and the angled edge comprise a peripheral edge of each of the first and second panels, and steps (b) and (d) pre-hem and final hem the peripheral edge of each of the first and second panels to form the joint.

12. The method of claim 11, wherein the elevating of each of the pre-hemming and final hemming die blocks further comprises pinning each of the pre-hemming and final hemming die blocks into the hemming position.

13. The method of claim 11, wherein the main die is raised and lowered by moving a first helical surface of a first cam mounted adjacent to the main die against a second helical surface complementary to the first helical surface of a second cam fixed to the main die.

14. The method of claim 11, wherein the pre-hemming and final hemming die blocks are mounted to a frame and the frame is moved to position the pre-hemming and final hemming die blocks at the hemming position.

15. A hemming apparatus for joining a flat edge of a first panel to an angled edge of a second panel comprising:

a) a main die configured to support the first and second panels;

b) a main die drive connected to the main die for moving the main die vertically between at least a home position and a hemming position;

c) at least one hemming die block assembly comprising a pre-hemming die block and a final hemming die block supported by a frame; and d) at least one hemming die block assembly drive mounted on a fixed support and positioned adjacent the main die, and adapted to move the frame along a drive path for positioning each of the pre-hemming die block and the final die block at the hemming position to perform pre-hemming and final hemming on the flat edge of the first and the angled edge of the second panel, wherein the main die drive further comprises a pair of first and second cams, the first cam fixed to the die and having a first cam surface, the second cam having a second cam surface and being mounted to a drive mechanism for translation between a first position and a second position, the first position corresponding to a home position of the main die and the second position corresponding to a hemming position of the main die whereby translation of the second cam against the first cam raises the main die for pre-hemming and final hemming.

16. The apparatus of claim 15, wherein the drive translates the second cam in one of a rotary movement, an arcuate movement, or a linear movement to move the main die.

17. A hemming die block assembly for positioning hemming die blocks for joining a flat edge of a first panel to an angled edge of a second panel comprising:

a) a pre-hemming die block and a final hemming die block supported by a frame; and d) at least one hemming die block assembly drive mounted on a fixed support and positioned adjacent a main die adapted to support the first and second panels, the drive adapted to move the frame along a linear drive path inclined with respect to vertical for positioning each of the pre-hemming die block and the final die block at one hemming position to perform pre-hemming and final hemming on the flat edge of the first panel and the angled edge of the second panel.

18. The assembly of claim 17, wherein the frame is mounted on a pair of inclined ways for travel along the inclined drive path, the frame having a keeper mounted adjacent to each way to retain the frame on the pair of ways, at least one surface of the keepers, ways, and frame that oppose each other and that move with respect to each other having a hand scraped surface to maintain precision travel of the frame during the positioning of the pre-hemming and final hemming die blocks.

19. The assembly of claim 17, wherein the at least one hemming die block assembly further comprises at least one shot pin mounted to the fixed support, the shot pin having a pin moveable between a rest position and a fixing position, the frame having at least one first opening for pre-hemming and at least one second opening for final hemming, each of the at least one first and second openings sized to receive an end of the pin, the shot pin operable to extend the at least one pin into the first opening to fix the frame and the pre-hemming die block for pre-hemming after frame movement of the pre-hemming die block to the hemming position, and to extend the at least one pin into the second opening to fix the frame and the final hemming die block for final hemming after frame movement of the final hemming die block to the hemming position.

20. The assembly of claim 17, wherein the frame has a gear rack mounted thereon, and the at least one hemming die block assembly drive further comprises a gear driven by a motor assembly, rotation of the gear by the motor assembly and meshing of the gear with the gear rack moving the frame along the inclined drive path.

* * * * *